US009099814B2

(12) United States Patent
Snader et al.

(10) Patent No.: US 9,099,814 B2
(45) Date of Patent: Aug. 4, 2015

(54) SHIELDED ELECTRICAL HEADER ASSEMBLY

(71) Applicant: DELPHI TECHNOLOGIES, INC., Troy, MI (US)

(72) Inventors: Robert B. Snader, Vienna, OH (US); Terry A. George, Salem, OH (US); Christopher Adrian Margrave, Warren, OH (US); John L. Wicks, Cortland, OH (US); Julie H. Strama, Vienna, OH (US)

(73) Assignee: Delphi Technologies, Inc., Troy, MI (US)

( * ) Notice: Subject to any disclaimer, the term of this patent is extended or adjusted under 35 U.S.C. 154(b) by 192 days.

(21) Appl. No.: 13/942,850

(22) Filed: Jul. 16, 2013

(65) Prior Publication Data

US 2015/0024629 A1 Jan. 22, 2015

(51) Int. Cl.

| | |
|---|---|
| ***H01R 13/52*** | (2006.01) |
| ***H01R 13/6591*** | (2011.01) |
| ***H01R 13/6599*** | (2011.01) |
| ***H01R 13/6585*** | (2011.01) |
| ***H01R 13/6596*** | (2011.01) |
| ***H01R 13/74*** | (2006.01) |
| ***H01R 43/24*** | (2006.01) |
| *H01R 13/405* | (2006.01) |

(52) U.S. Cl.

CPC ..... *H01R 13/6591* (2013.01); *H01R 13/5219* (2013.01); *H01R 13/6585* (2013.01); *H01R 13/6596* (2013.01); *H01R 13/6599* (2013.01); *H01R 13/748* (2013.01); *H01R 43/24* (2013.01); *H01R 13/405* (2013.01); *H01R 2201/26* (2013.01)

(58) Field of Classification Search

CPC ..... H01R 13/6591

See application file for complete search history.

(56) References Cited

U.S. PATENT DOCUMENTS

| | | | | |
|---|---|---|---|---|
| 5,509,823 | A * | 4/1996 | Harting et al. | 439/607.17 |
| 6,488,533 | B1 * | 12/2002 | Thompson et al. | 439/509 |
| 6,863,545 | B2 * | 3/2005 | Peloza | 439/79 |
| 7,364,458 | B1 * | 4/2008 | Ju | 439/524 |
| 7,390,219 | B2 * | 6/2008 | Pan | 439/607.13 |
| 7,575,476 | B2 | 8/2009 | Tyler et al. | |
| 7,811,115 | B1 | 10/2010 | Tyler | |
| 8,147,272 | B2 | 4/2012 | Rhein | |
| 8,235,744 | B1 | 8/2012 | Liptak et al. | |
| 8,333,613 | B2 | 12/2012 | De Chazal et al. | |

(Continued)

FOREIGN PATENT DOCUMENTS

WO 2012019986 A1 2/2012

*Primary Examiner* — James Harvey
(74) *Attorney, Agent, or Firm* — Robert J. Myers

(57) ABSTRACT

A shielded electrical header assembly is provided. The header is configured to be coupled to a first connector connected to a shielded electrical cable and second connector. The header is also configured to be attached to an electrically conductive panel, such as an aluminum battery pack in a hybrid or electric vehicle. The header includes a conductive shield contact that connects the outer conductor of the shielded cable to the panel and a conductive outer connector body that is also connected to the panel and surrounds the terminals and the shield contact of the header, thus providing electromagnetic shielding to the terminals of the header and the connectors. The shield contact is formed of a sheet metal to provide a lower resistance connection between the outer conductor and the panel. A method of manufacturing such a header is also provided.

12 Claims, 6 Drawing Sheets

(56) References Cited

U.S. PATENT DOCUMENTS

| | | | | |
|---|---|---|---|---|
| 8,360,808 | B2 * | 1/2013 | Tsuchiya | 439/607.55 |
| 2002/0063025 | A1 * | 5/2002 | Raypole et al. | 188/322.19 |
| 2012/0208400 | A1 * | 8/2012 | De Chazal et al. | 439/607.58 |
| 2013/0178100 | A1 * | 7/2013 | Nagata et al. | 439/607.35 |
| 2014/0004740 | A1 * | 1/2014 | Uno et al. | 439/607.58 |
| 2014/0199892 | A1 * | 7/2014 | Lan | 439/660 |
| 2015/0024629 | A1 * | 1/2015 | Snader et al. | 439/607.01 |

* cited by examiner

SHIELDED ELECTRICAL HEADER ASSEMBLY

TECHNICAL FIELD OF THE INVENTION

The invention generally relates to shielded electrical header assembly, and more particularly relates to a header assembly configured to couple with a shielded electrical cable and attach to an electrically conductive panel.

BACKGROUND OF THE INVENTION

In electrical wiring harnesses, such as those used in automobiles, there is often a need for an electrical connection to pass through a panel or bulkhead, for instance the barrier between the passenger compartment and the engine compartment or the outer case of an electric vehicle battery pack. The connection through the bulkhead is typically made by a header having two sets of interconnected terminals, one set to connect to a wiring harness connector on one side of the bulkhead and a second set to connect to another wiring harness connector on the other side of the bulkhead. The header may provide features for environmentally sealing the connections and the bulkhead to inhibit unwanted contaminants, e.g. water or dust, from contacting the terminals or penetrating the bulkhead.

In certain high voltage circuits, for example circuits conducting the primary power supply from the battery pack to a motor in an electric vehicle, shielded electrical cables may be used with the header. As used herein, a shielded electrical cable contains a conductive center core insulated from an outer conductor, e.g. a coaxial cable. The outer conductor provides protection or shielding from electromagnetic interference that may be generated by the high voltages conducted by the conductive core. The outer conductor provides protection from electromagnetic interference that may be generated by high voltages conducted by the conductive core and is typically connected to an electrical ground. A header used with a shielded cable should maintain shielding of the outer conductor on at least one side of the bulkhead. In some known header designs, shielding is provided by a sheet metal box that surrounds the terminals and is connected to the outer conductor and the electrical ground.

In the expanding applications for high voltage connection systems used on hybrid and/or electric vehicles, automobile manufacturers have expressed interest in a shielded header that allows a connector to mate in a direction that is generally parallel to the bulkhead to which the header attached. Therefore, a header is desired that is designed to mate to an existing environmentally sealed high voltage female connector, with no modifications to the female connector. The header must electromagnetically shield the power and signal terminals from the female connector and ground to the bulkhead. The header must be environmentally sealed. The header must mate to a connector with an orientation generally parallel to the mounting surface of the header, typically referred to as a right angle header.

A header having a sheet metal box that axially surrounds the conductive elements to provide a shield and an electrical path between the outer conductor and the bulkhead may be fairly easily constructed for a header when the conductive elements are straight, such as those in a straight header where the first and second connector are both oriented perpendicularly to the bulkhead. An example of such a shielded header may be found in U.S. Pat. No. 8,235,744 granted on Aug. 7, 2012 to Liptak, et al. However, forming a sheet metal box to surround conductive elements that are not straight, such as those required for a right angle header is much more complex and the manufacturing processes needed would undesirably add cost to the header. WIPO International Patent Application WO 2012/019986 published Feb. 16, 2012 shows such a shielded right angle header. This right angle header requires two separate sheet metal shields to provide electromagnetic shielding to the terminals of the header.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

In accordance with one embodiment of this invention, a shielded electrical header assembly that is configured to couple with a shielded electrical cable and is further configured to be attached to an electrically conductive panel is provided. The assembly includes a conductive element that defines both a first terminal and a second terminal and an inner connector body that is formed of a dielectric material that surrounds a portion of the conductive element, leaving the first and second terminal unenclosed. The assembly also includes a conductive shield contact that has a shield portion axially surrounding the first terminal and further having an integral contact portion that extends from the shield portion and terminates in a flexible contact. The flexible contact is configured to provide electrical connection between the shield contact and the conductive panel. A free end of the contact portion is generally parallel to the second terminal. The assembly additionally includes a conductive outer connector body that axially surrounds the shield contact and the inner connector body. The outer connector body is adapted to attach the assembly to the panel. The outer connector body is preferably formed of a conductive thermoplastic material.

In another embodiment of the present invention, a method of manufacturing a shielded electrical header assembly that is configured to couple with a shielded electrical cable and configured to be attached to an electrically conductive panel is provided. The method includes the steps of providing a conductive element defining both a first terminal and a second terminal, integrally molding a dielectric material over a portion of the conductive element so as to form an inner connector body, and forming a shield contact from a conductive material. The shield contact has a shield portion having two opposed open ends and an integral contact portion extending from the shield portion and terminates in a flexible contact. The method also includes the step of attaching the shield contact to the inner connector body so that the shield portion axially surrounds the first terminal while a free end of the contact portion is generally parallel to the second terminal and the step of integrally molding conductive material over the inner connector body and the shield contact so as to form an outer connector body leaving the first and second terminal unenclosed. The outer connector body defines a first opening configured to provide access to the first terminal and a second opening configured to provide access to the second terminal. The outer connector body is adapted to attach the assembly to the panel.

Further features and advantages of the invention will appear more clearly on a reading of the following detailed description of the preferred embodiment of the invention, which is given by way of non-limiting example only and with reference to the accompanying drawings.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Figure 1:
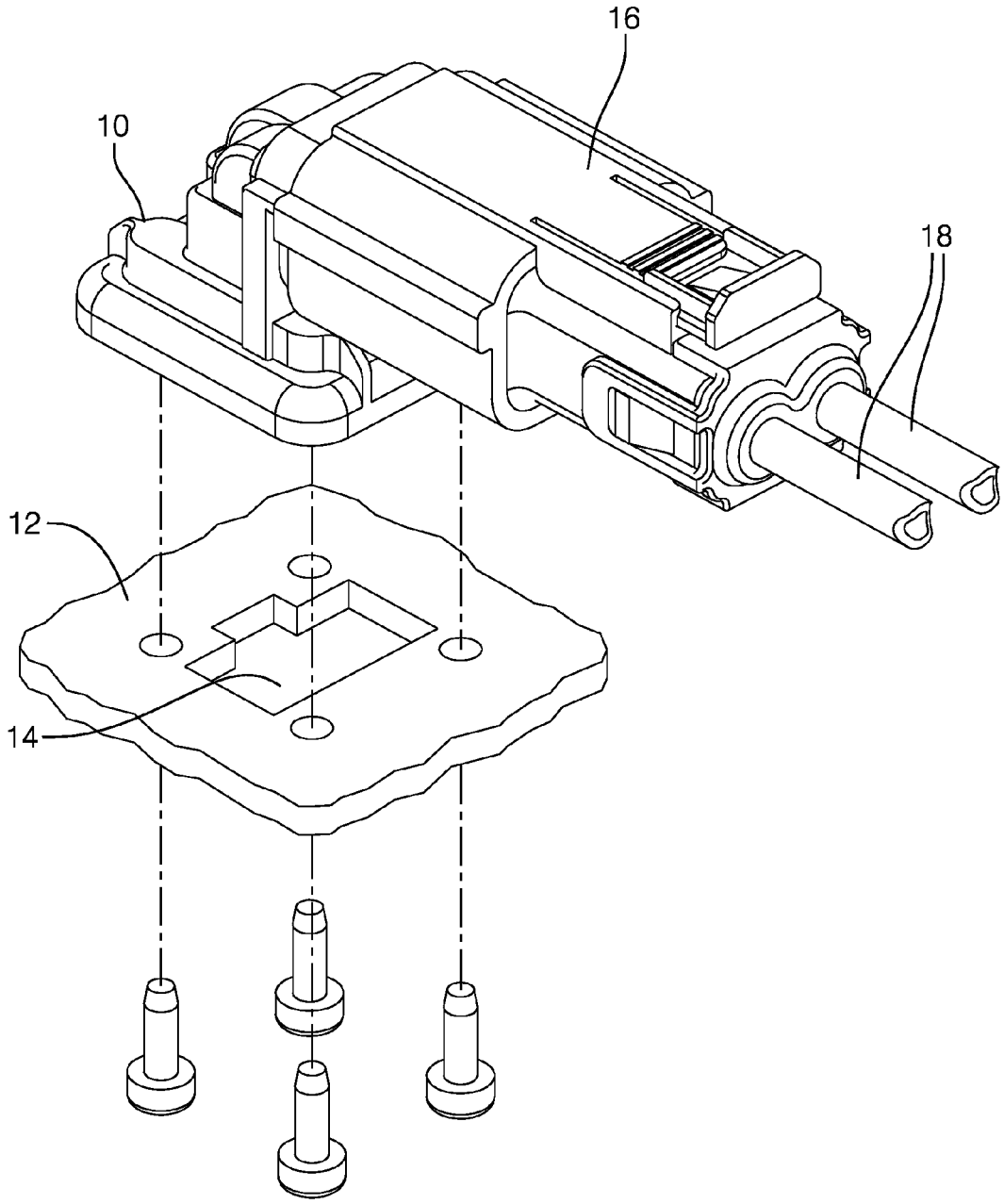
FIG. 1 is an exploded view of a shielded electrical header, a first mating connector, a second mating connector, and a conductive bulkhead in accordance with one embodiment.

The shielded electrical header assembly presented herein is designed to be mounted to a conductive bulkhead. The header assembly is configured to connect to a shielded cable and to provide an electromagnetic shield for the connections between the header and the shielded cable. The header may be designed to connect with a connector that is generally parallel to the surface on which the header is mounted, although other connector/header orientations may easily be envisioned.

FIGS. 1 and 2A-2C illustrate a non-limiting example of a shielded electrical header assembly 10, hereafter referred to as the header 10. The header 10 is configured to be attached to a conductive panel 12 or bulkhead 12 having a portal 14 or opening 14 in the bulkhead 12, in this example the aluminum outer wall of a battery pack case of an electric vehicle. The header 10 is configured to be attached to two different mating connectors. The first mating connector 16 is a sealed connector for making an electrical connection between the header 10 and shielded electrical cables 18 outside of the battery pack case. The second mating connector 20 is a non-sealed connector for making an electrical connection between the header 10 and non-shielded cables (not shown), i.e. a wire cable including a conductive core, but not an outer conductor, inside of the battery back case. The header 10 affords an electrical pass-through connection for the bulkhead 12 or wall of the battery pack case.

Figure 3:
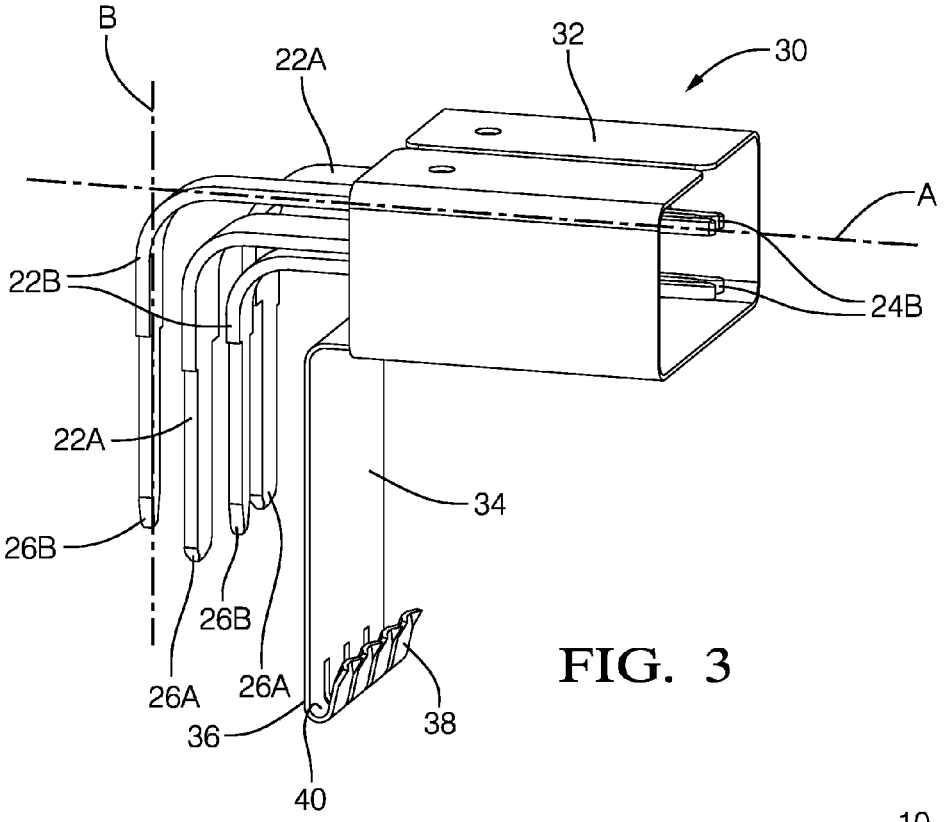
FIG. 3 is a perspective view of conductive elements and a shield contact that is disposed within the shielded electrical header of FIG. 1 in accordance with one embodiment.

As illustrated in FIG. 3, the header 10 includes a plurality of conductive elements 22 that are configured to electrically couple the terminals of the first mating connector 16 to the terminals of second mating connector 20. Each of the conductive elements 22 define a first terminal 24 that is configured to mate with a corresponding terminal (not shown) in the first mating connector 16 and a second terminal 26 that is configured to mate with a corresponding terminal (not shown) in the second mating connector 20. In the example presented here, the header 10 includes two larger conductive elements 22A sized to carry the current of the positive and negative battery pack terminals. The header 10 also includes two smaller conductive elements 22B sized to carry lower current electrical signals. The smaller conductive elements 22B in this example are part of a high voltage interlock (HVIL) circuit. The two terminals 24B of the smaller conductive elements 22B are shunted when connected to the corresponding mating terminals in the first mating connector 16. Transmission of high voltage on the larger conductive elements 22A is inhibited until a controller connected to the smaller conductive elements 22B detects a short circuit created when the first and second terminals 24, 26 are mated with the corresponding mating terminals.

The conductive elements 22 are typically formed from a sheet of electrically conductive material, for example, a copper alloy that may include plating layers on the surface of the sheet to reduce corrosion resulting in a conductive element having a rectangular cross section. The conductive elements 22 may be formed using machining techniques known for forming such elements including stamping and coining. The first terminals 24A and second terminals 26A, 26B shown in this example are male rectangular blade or plug terminals that are configured to mate with corresponding female socket terminals in the first and second mating connectors. The second terminals 24B are "tuning fork" terminals configured to mate with corresponding male plug terminals in the first mating connector 16. Alternatively, the conductive elements may have other cross sectional shapes e.g. square or round. The first and/or second terminals may alternatively be female socket terminals configured to mate with corresponding male plug terminals in the first and second mating connectors.

Figure 4:
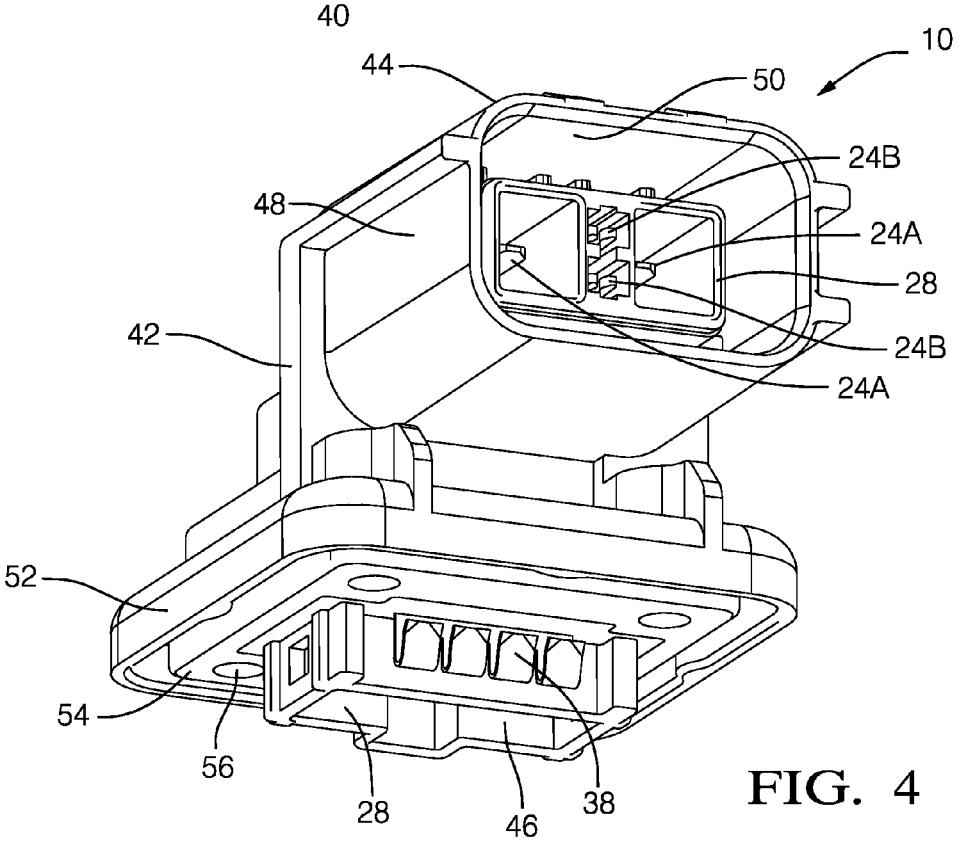
FIG. 4 is a perspective view of the shielded electrical header of FIG. 1 in accordance with one embodiment.
Figure 5:
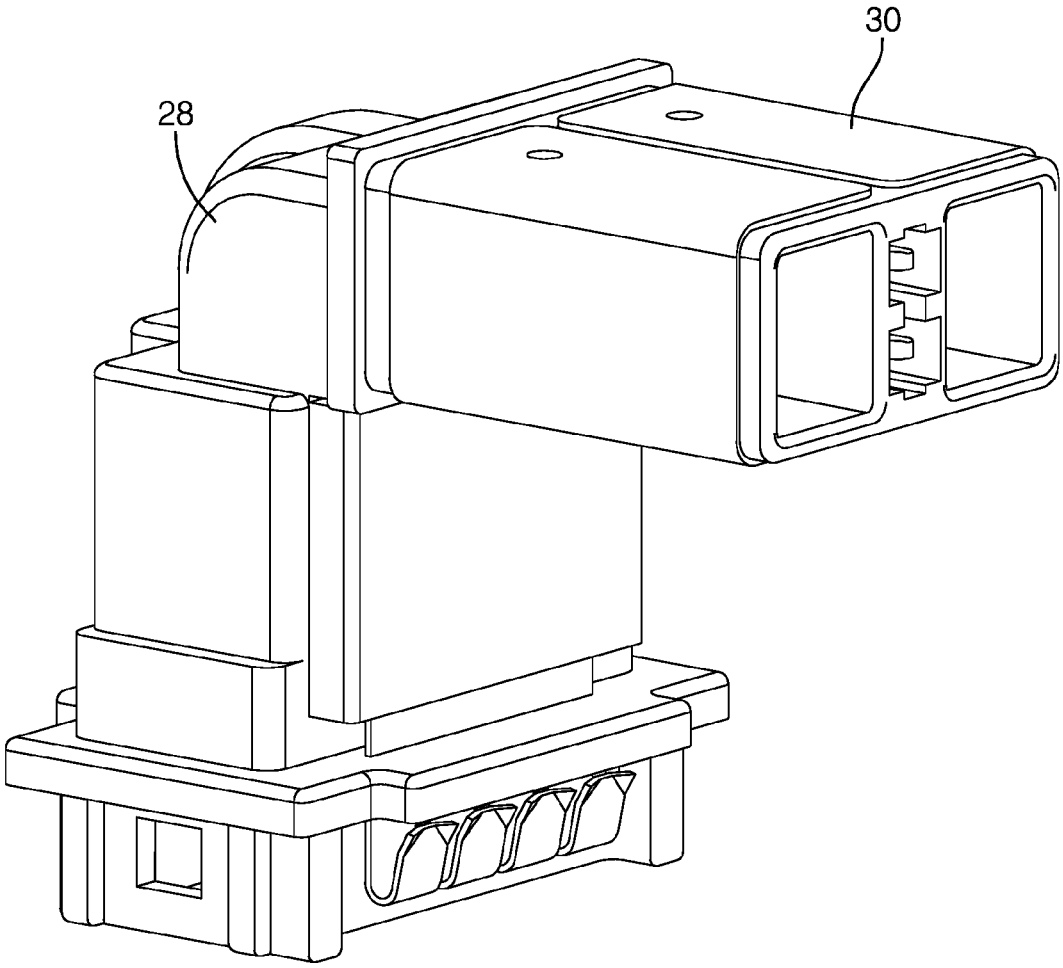
FIG. 5 is a perspective view of the inner connector body and shield contact that is disposed within the shielded electrical header of FIG. 1 in accordance with one embodiment.

As illustrated in FIG. 4, the header 10 also includes an inner connector body 28 that surrounds at least a portion of each conductive element, leaving the first and second terminals 24, 26 unenclosed within the inner connector body 28. The inner connector body 28 is formed of an insulative dielectric material, e.g. a polyamide plastic commonly known by the trade name NYLON. The inner connector body 28 is designed to electrically insulate the conductive elements 22 one from another. The inner connector body 28 also physically supports the conductive elements 22 and maintains the position of the conductive elements 22 within the header 10. The conductive elements 22 are spaced apart from each other within the inner connector body 28 to prevent voltage creep between them.

In the illustrated example, the header 10 is designed to connect with a first mating connector 16 that oriented generally parallel to the surface on which the header 10 is mounted while connecting with a second mating connector 20 that is oriented generally perpendicular to the surface on which the header 10 is mounted. Therefore a first axis A defined by one of the first terminals 24 that connects to a corresponding mating terminal in the first mating connector 16 is not parallel to a second axis B defined by one of the second terminals 26 that connects to a corresponding mating terminal in the second mating connector 20; in fact the first axis A is generally perpendicular to the second axis B. As used herein, generally perpendicular is ±30° of absolutely perpendicular. This configuration is typically referred to in the automotive industry as a right angle header.

As best illustrated in FIG. 3, the header 10 further includes a shield contact 30 having a shield portion 32 that axially surrounds the first terminals 24 and has an integral contact portion 34 that extends from the shield portion 32 and terminates in a flexible contact 36 configured to make an electrical connection between the shield contact 30 and the bulkhead 12. The shield portion 32 axially surrounds both the first terminals 24 and a portion of the inner connector body 28. The shield portion 32 is designed to electrically couple to the outer conductor of the shielded cable 18 by connecting with a mating shield contact (not shown) in the first mating connector 16 that is connected to the outer conductor. The contact portion 34 includes a plurality of contact fingers 38 that extend from the shield portion 32 and are configured to contact a conductive edge of the opening 14 in the bulkhead 12 (as best shown in FIG. 6B) providing a conductive path from the shield portion 32 to the bulkhead 12. The contact fingers 38 are located at the free end of the contact portion 34, i.e. the end of the contact portion 34 that is not attached to the shield portion 32. Each contact finger 38 is a flexible contact 36 that defines a J shape 40 and is designed to flex and exert a spring force on the edge of the opening 14, thus establishing a more robust electrical connection between the shield contact 30 and the conductive panel 12. The flexible contact 36 is generally parallel to the second terminal 26. The shield contact 30 is typically formed from a sheet of electrically conductive material, for example, a copper alloy that may include plating layers on the surface of the sheet to reduce corrosion.

In the illustrated example, the contact portion 34 is only located on one side of the second terminal 26, the contact portion 34 does not axially surround the second terminal 26. Other embodiments of the header may be envisioned wherein a second plurality of contact fingers extend from the shield portion and contact the opposing edge of the opening. Also in the illustrated example, the inner connector body 28 surrounds a portion of the shield contact 30, i.e. part of the contact portion 34 is embedded within the inner connector body 28. Alternatively, the entire shield contact may be external to the inner connector body.

Figure 2C:
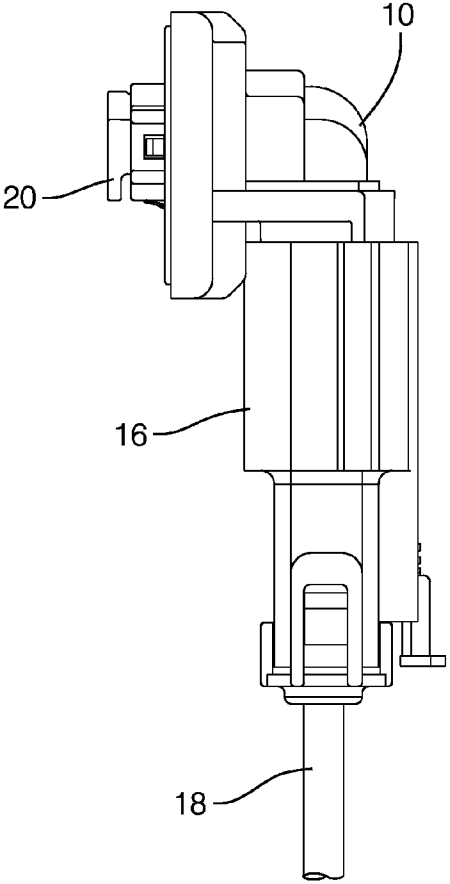
FIG. 2C is side plan view of the shielded electrical header, the first mating connector, and the second mating connector of FIG. 1 in accordance with one embodiment.
Figure 2B:
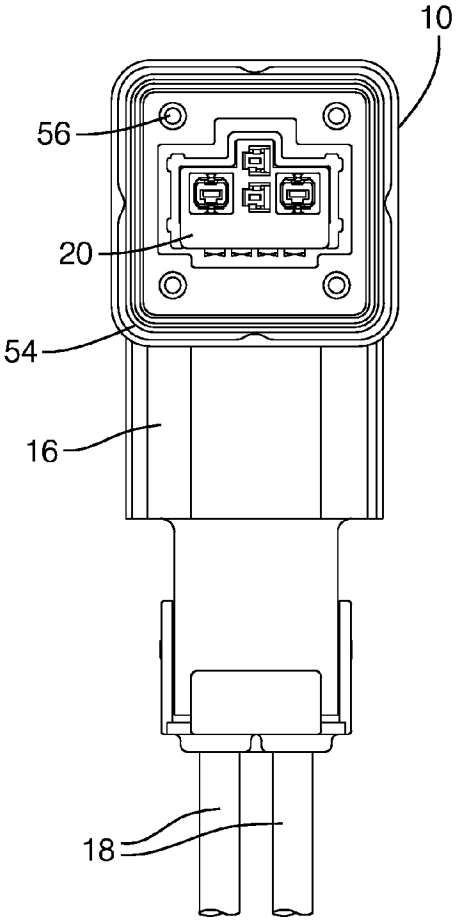
FIG. 2B is bottom plan view of the shielded electrical header, the first mating connector, and the second mating connector of FIG. 1 in accordance with one embodiment.
Figure 2A:
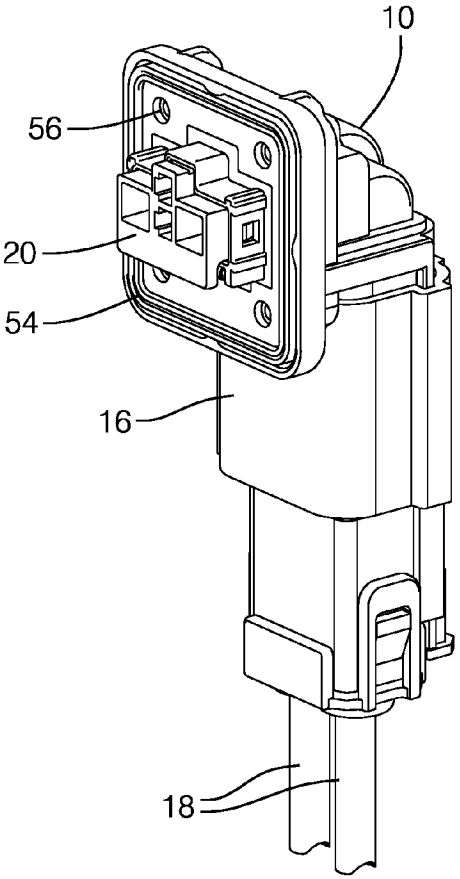
FIG. 2A is bottom perspective view of the shielded electrical header, the first mating connector, and the second mating connector of FIG. 1 in accordance with one embodiment.

As illustrated in FIG. 4, the header 10 additionally includes a conductive outer connector body 42 that axially surrounds both the shield contact 30 and the inner connector body 28. The conductive outer connector body 42 is adapted to attach the header 10 to the conductive panel 12. The outer connector body 42 defines two openings, a first opening 44 to receive the first mating connector 16 and a second opening 46 to receive the second mating connector 20. The first opening 44 defines a shroud 48 that is designed to receive the first mating connector 16 and an inner surface 50 of the shroud 48 provides a sealing surface for a compliant seal (not shown) attached to the first mating connector 16, thereby providing an environmental seal between the first mating connector 16 to the header 10. The header 10 also defines a base 52 surrounding the second opening 46. As shown in FIGS. 2A and 2B, the base 52 may include a complaint seal 54 that surrounds the second opening 46 and is adapted to environmentally seal the base 52 of the header 10 to the bulkhead 12.

Figure 6A:
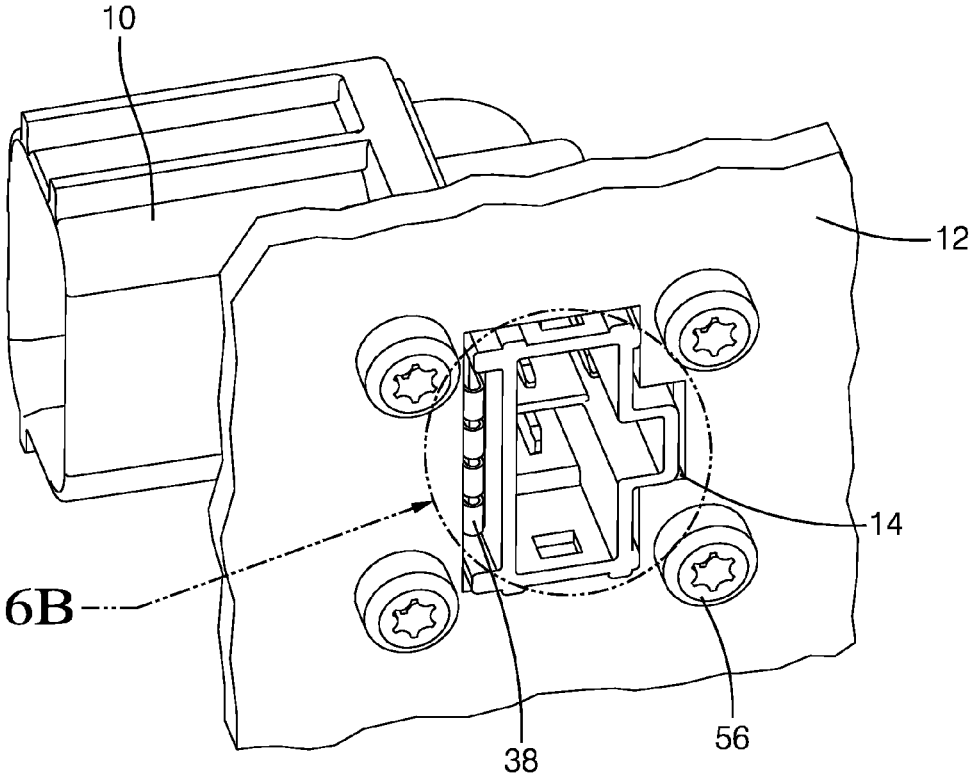
FIG. 6A is a is bottom perspective view of the shielded electrical header and conductive bulkhead of FIG. 1 in accordance with one embodiment.
Figure 6B:
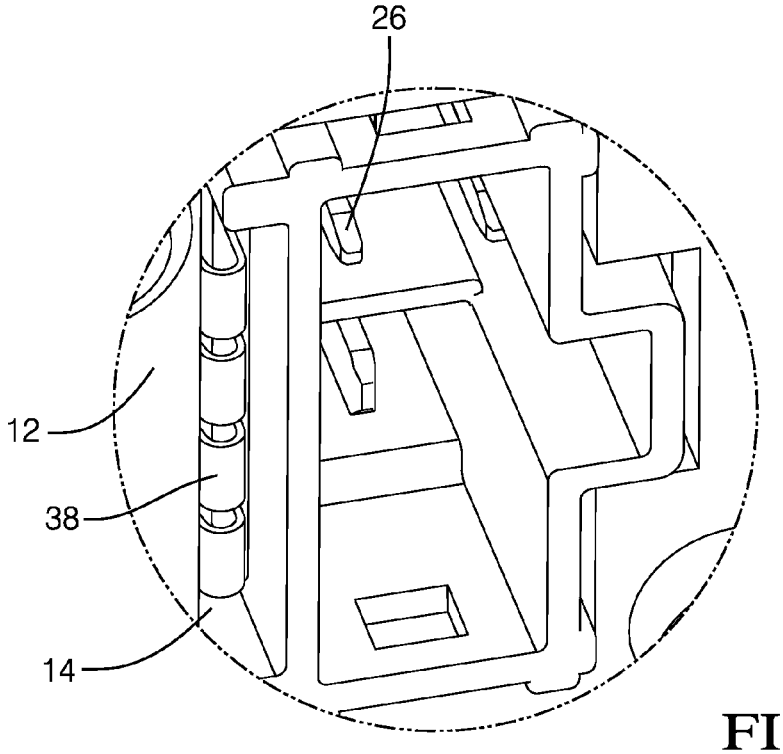
FIG. 6B is a close up perspective view of an aperture in the conducive bulkhead and a flexible contact of the shielded electrical header of FIG. 6A in accordance with one embodiment.

Returning now to FIG. 4, the base 52 includes attachment features 56, such as threaded holes 56 that are designed to attach the header 10 to the bulkhead 12 using conductive threaded fasteners 58 as illustrated in FIG. 6A, thereby providing an electrically conductive path between the outer connector body 42 and the bulkhead 12. The threaded holes 56 are preferably blind threaded holes 56 that are located within the perimeter of the seal 54 in order to eliminate a potential leak path through the threaded holes 56. Other means of attaching the header 10 to the bulkhead 12 may alternatively be used. For instance, the header may define unthreaded holes and conductive threaded fasteners may be inserted through the unthreaded holes and the held to the bulkhead by conductive threaded nuts or the header may be attached to the bulkhead by conductive rivets. The outer connector body 42 is formed of a conductive thermoplastic material, for example a polybutylene terephthalate (PBT) plastic filled with nickel plated carbon fibers. Such a material is available from ElectriPlast Corporation of Fort Washington, Pa.

The electrically conductive outer connector body 42 is designed to be electrically as well as mechanically connected to bulkhead 12, thereby electrically shielding the first and second terminals 24, 26. The corresponding mating terminals in the first mating connector 16 may be shielded if the connector body of the first mating connector 16 is also formed of a conductive material. The shield contact 30 furnishes an electrically conductive path between the outer conductor and the bulkhead 12. Since the shield contact 30 is formed of a sheet metal, it typically has a lower electrical resistance than the outer conductor which is formed of a conductive plastic. Thus, a right angle header 10 that offers the benefit of shielding the first and second terminals 24, 26 while having a low resistance path to ground for the outer conductor of the shielded cable 18 is provided.

While the header 10 illustrated in FIGS. 1-6B is configured to connect with a first mating connector 16 that is oriented generally parallel to the mounting surface of the header 10 and a second mating connector 20 that is generally perpendicular to the mounting surface i.e. a right angle header, other embodiments of the header may be envisioned with different orientations of the first and second connectors. For instance the first and second connector could both be oriented perpendicular to the mounting surface, both parallel to the mounting surface, or either at an angle to the mounting surface between parallel and perpendicular. Further, the illustrated header is designed to mate with a female first connector and a male second connector. Other embodiments may be envisioned in which the header is configured to mate with a male first connector or a female second connector. The illustrated header 10 is designed to connect to a second mating connector 20. Other embodiments may be envisioned wherein wires are attached directly to the conducive elements, for example by soldering or welding wires to the conductive elements. In other embodiments, the wires may be attached to the conductive elements using individual terminals, i.e. no second mating connector body.

Figure 7:
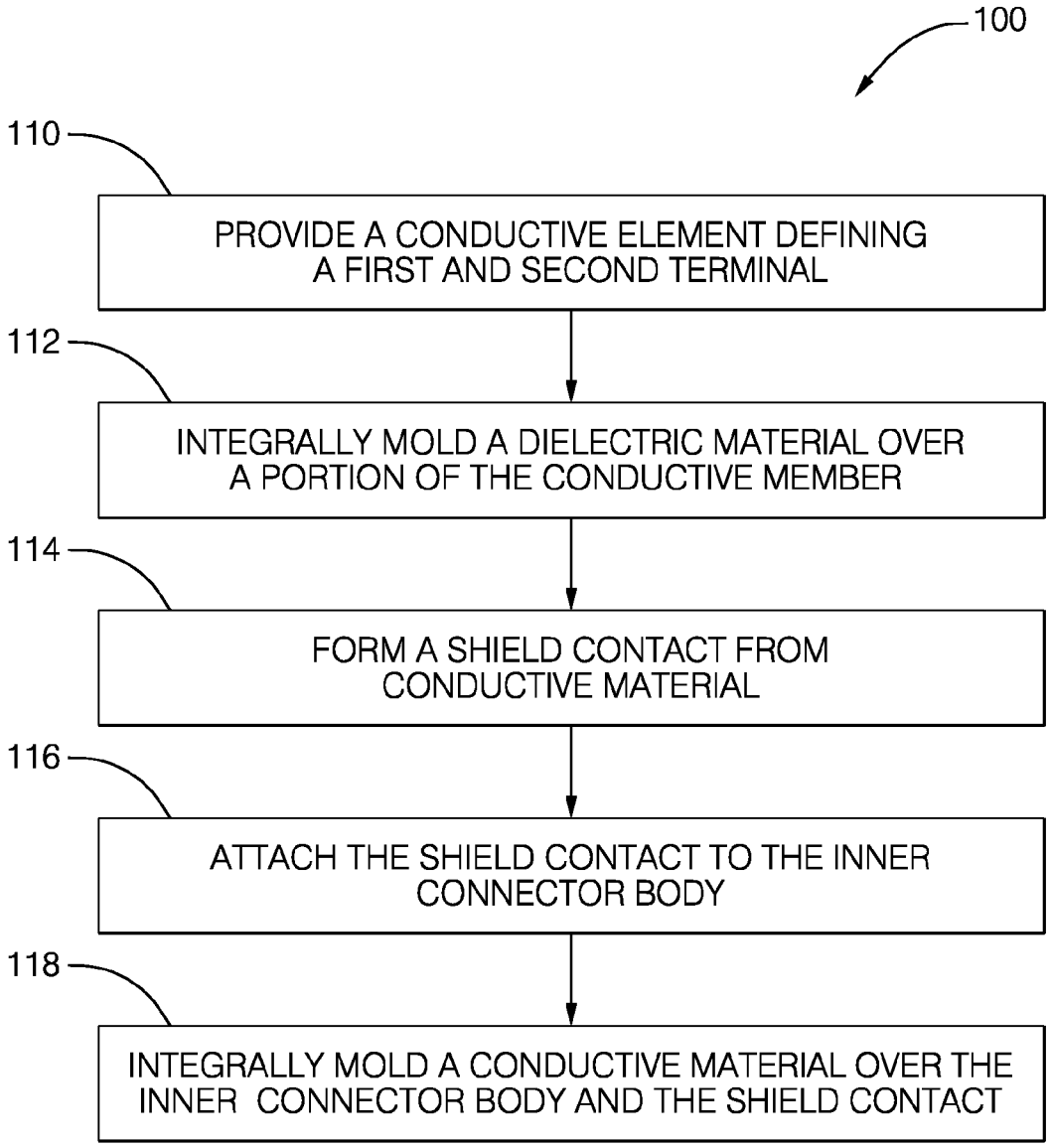
FIG. 7 is a flow chart of a method of manufacturing a shielded electrical header assembly that is configured to be coupled to a shielded electrical cable and attached to an electrically conductive panel 6A in accordance with one embodiment.

FIG. 7 illustrates a method 100 method of manufacturing a shielded electrical header assembly that is configured to be coupled to a shielded electrical cable and attached to an electrically conductive panel. The header 10 described supra may be manufactured according to this method 100.

In step 110, PROVIDE A CONDUCTIVE ELEMENT DEFINING A FIRST AND SECOND TERMINAL, a conductive element defining a first and second terminal, such as the conductive elements 22 described supra is provided.

In step 112, INTEGRALLY MOLD A DIELECTRIC MATERIAL OVER A PORTION OF THE CONDUCTIVE MEMBER, the conductive member is placed into mold and a dielectric material is introduced into the mold. The molding process used here may be described as insert molding, a process well known to those skilled in the art. The dielectric material may by poured or injected into the mold and the dielectric material thereafter hardens into an inner connector body, e.g. the inner connector body 28 described supra.

In step 114, FORM A SHIELD CONTACT FROM CONDUCTIVE MATERIAL, a shield contact is formed from a conductive material. The shield contact, such as the shield contact 30 described supra, may be formed by stamping or laser cutting the metal sheet and forming the sheet into the desired shape by bending into a desired shape, e.g. the shape of the shield portion 32 and the contact portion 34.

In step 116, ATTACH THE SHIELD CONTACT TO THE INNER CONNECTOR BODY, the shield contact 30 is attached to the inner connector body 28. The shield contact 30 may be attached to the exterior of the inner connector body 28 or the shield contact 30 may be placed into the mold with the conductive member in step 112 and the shield contact 30 may be integrally attached to the inner connector body 28 by molding dielectric material over a portion of the shield contact 30.

In step 118, INTEGRALLY MOLD A CONDUCTIVE MATERIAL OVER THE INNER CONNECTOR BODY AND THE SHIELD CONTACT, the inner connector body 28 and the shield contact 30 are placed into mold and a conductive thermoplastic material is introduced into the mold. The molding process used here may be described as overmolding, a process well known to those skilled in the art. The conductive material may by poured or injected into the mold and the conductive material thereafter hardens into an outer connector body, such as the outer connector body 42 described supra.

Accordingly, a shielded electrical header assembly 10 configured to be coupled to a shielded electrical cable and configured to be attached to an electrically conductive panel 12 and a method 100 of manufacturing a shielded electrical header assembly 10 that is configured to be coupled to a shielded electrical cable and attached to an electrically conductive panel 12 is provided. The conductive outer connector body 42 of the header 10 furnishes electromagnetic shielding for the terminals within the header 10 as well as a ground path from the connector body of the first mating connector 16 to the conductive panel 12 on which the header 10 is mounted. The shield contact 30 makes a low resistance electrical connection between the outer conductor of a shielded cable 18 connected to the header 10 and the conductive panel 12 to which the header 10 is mounted. The header 10 can be fashioned in a right angle header configuration without the need to have a sheet metal box with multiple parts that surrounds the first and second terminals 24, 26 in the header 10 as described in the Background of the Invention.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

We claim:

1. A shielded electrical header assembly configured to be coupled to a shielded electrical cable and configured to be attached to an electrically conductive panel, said assembly comprising:

a conductive element defining a first terminal and a second terminal;

a dielectric inner connector body surrounding at least a portion of the conductive element leaving the first and second terminal unenclosed;

a conductive shield contact having a shield portion axially surrounding the first terminal and having an integral contact portion extending from said shield portion and terminating in a flexible contact configured to provide electrical connection between the shield contact and the panel, wherein a free end of the contact portion is generally parallel to the second terminal and the flexible contact defines a J shape; and a conductive outer connector body axially surrounding the shield contact and the inner connector body and adapted to attach the assembly to the panel.

2. The assembly according to claim 1, wherein the outer connector body is formed of a conductive thermoplastic material.

3. The assembly according to claim 2, wherein the first terminal of the conductive element defines a first axis and the second terminal of the conductive element defines a second axis and wherein the first axis is not parallel to the second axis.

4. The assembly according to claim 3, wherein the first axis is generally perpendicular to the second axis.

5. The assembly according to claim 3, wherein the contact portion does not axially surround the second terminal.

6. A method of manufacturing a shielded electrical header assembly that is configured to be coupled to a shielded electrical cable and attached to an electrically conductive panel, said method comprising:

providing a conductive element defining a first terminal and a second terminal;

integrally molding a dielectric material over a portion of the conductive element so as to form an inner connector body leaving the first and second terminal unenclosed;

forming a shield contact from conductive material, said shield contact having a shield portion having two opposed open ends and an integral contact portion extending from said shield portion and terminating in a flexible contact, wherein the flexible contact defines a J shape;

attaching the shield contact to the inner connector body so that the shield portion axially surrounds the first terminal and a free end of the contact portion is generally parallel to the second terminal;

integrally molding conductive material over the inner connector body and the shield contact so as to form an outer connector body, said outer connector body defining a first opening configured to provide access to the first terminal and a second opening configured to provide access to the second terminal, said outer connector body adapted to attach the assembly to the panel.

7. The assembly according to claim 5, wherein the outer connector body surrounds a portion of the first terminal.

8. The assembly according to claim 7, wherein the shield portion of the shield contact surrounds a portion of the inner connector body.

9. The method according to claim 6, wherein the conductive material in the step of integrally molding conductive material over the inner connector body and the shield contact is a conductive thermoplastic material.

10. The method according to claim 9, wherein the first terminal defines a first axis and the second terminal defines a second axis and wherein the first axis is not parallel to the second axis.

11. The method according to claim 10, wherein the first axis is generally perpendicular to the second axis.

12. The method according to claim 11, wherein the contact portion does not axially surround the second terminal.

* * * * *